US006920304B2

(12) United States Patent
Kanesawa et al.

(10) Patent No.: US 6,920,304 B2
(45) Date of Patent: Jul. 19, 2005

(54) RELIEF SMOOTHING APPARATUS, FIXING DEVICE, AND IMAGE FORMING APPARATUS

(75) Inventors: Yoshio Kanesawa, Nakai-machi (JP); Ashita Murai, Fujinomiya (JP)

(73) Assignees: Fuji Xerox Co., Ltd., Tokyo (JP); Fuji Photo Film Co., Ltd., Minami-Ashigara (JP)

( * ) Notice: Subject to any disclaimer, the term of this patent is extended or adjusted under 35 U.S.C. 154(b) by 41 days.

(21) Appl. No.: 10/727,624

(22) Filed: Dec. 5, 2003

(65) Prior Publication Data

US 2004/0120738 A1 Jun. 24, 2004

(30) Foreign Application Priority Data

Dec. 20, 2002 (JP) ..... 2002-371163

(51) Int. Cl.[7] ..... G03G 15/20
(52) U.S. Cl. ..... 399/328; 399/329; 399/341
(58) Field of Search ..... 219/216; 399/324, 399/328, 329, 341; 428/451; 430/124

(56) References Cited

U.S. PATENT DOCUMENTS 5,516,394 A 5/1996 Rimai et al.
6,010,791 A * 1/2000 Tan et al. ..... 428/451
6,733,943 B2 * 5/2004 Finn et al. ..... 430/124
6,771,926 B2 * 8/2004 Ishikawa et al. ..... 399/329

FOREIGN PATENT DOCUMENTS

| | | |
|---|---|---|
| JP | A 61-122665 | 6/1986 |
| JP | A 61-122666 | 6/1986 |
| JP | A 2002-091048 | 3/2002 |

* cited by examiner

*Primary Examiner*—Hoang Ngo
(74) *Attorney, Agent, or Firm*—Oliff & Berridge, PLC

(57) ABSTRACT

To provide an relief smoothing apparatus that smoothes an image on a recording sheet which is obtained by forming a polyolefin resin coating layer on a base sheet and forming a receiving layer, in which a toner image is infiltrated, on the base sheet, including: plural tension rolls including a first roll; an endless; a second roll; and a heating source, the recording sheet, in which provided that a surface temperature of the first roll is represented by Tn [° C.], a Vicat softening temperature of the polyolefin resin is represented by Tv [° C.], and a time required for the recording sheet to pass through the nip portion is represented by t [sec], the following relationship is established: $(Tv+55)\times(1+1/100\ t) \geqq Tn \geqq (Tv+20)/(1+1/100\ t)$ [° C.].

20 Claims, 13 Drawing Sheets

RELIEF SMOOTHING APPARATUS, FIXING DEVICE, AND IMAGE FORMING APPARATUS

FIELD OF THE INVENTION AND RELATED ART STATEMENT

The present invention relates to a fixing device of an image forming apparatus adopting an electrophotographic system and an electrostatic transfer system, for example, a copying machine, a printer, a facsimile machine, and a multi-function machine thereof. In particular, the present invention relates to an improvement in a belt type fixing device.

Up to now, as a color image forming apparatus adopting an electrophotographic system, such as a color copying machine or a color printer, there is one having only one photosensitive drum on which toner images in respective colors of yellow (Y), magenta (M), cyan (C), and black (BK) are formed in order. The toner images in the respective colors of yellow (Y), magenta (M), cyan (C), and black (BK) formed in order on the photosensitive drum are multiply transferred onto a recording sheet, following heating the toner images and fixing the images onto the recording sheet to thereby form a color image. Also, as another example of the color image forming apparatus, there is one in which the toner images in the respective colors of yellow (Y), magenta (M), cyan (C), and black (BK) formed in order on the photosensitive drum temporarily undergo multiple primary-transfer onto an intermediate transfer member, after which the toner images in the respective colors, which have been multiply transferred onto the intermediate transfer member, collectively undergo secondary-transfer onto the recording sheet and heat application to be fixed onto the recording sheet, thereby forming a color image.

As still another example of the color image forming apparatus, there is one having plural image forming units corresponding to the respective colors of yellow (Y), magenta (M), cyan (C), and black (BK), in which the toner images in the respective colors of yellow (Y), magenta (M), cyan (C), and black (BK) formed in order on the photosensitive drums of the respective image forming units are multiply transferred onto the recording sheet or are temporarily subjected to the multiple primary-transfer onto the intermediate transfer member, after which the toner images in the respective colors, which have been multiply transferred onto the intermediate transfer member, collectively undergo the secondary-transfer onto the recording sheet and the heat application to be fixed onto the recording sheet, thereby forming a color image.

Incidentally, color toner to be transferred and fixed onto the recording sheet is generally prepared such that a colorant including a pigment, a dye, etc. is dispersed or melt-mixed into a binder resin. A particle size thereof is set to several $\mu$m to several tens of $\mu$m. The above color toner is transferred onto plain paper or coat paper such as general printing paper in a layered form and, is then fixed onto the plain paper or the coat paper such as the general printing paper in a heat-melted state.

As the fixing device of the color copying machine or printer adopting the electrophotographic system, a roll fixing device has been widely adopted, which is structured such that a fixing roll and a pressure roll are arranged face to face, and the image in a nip portion therebetween is fixed at a predetermined temperature with a predetermined load. On a color image surface after the fixing process by the roll fixing device, unevennesses are formed with a size of about 10 to 100 $\mu$m, for example, because of a difference in thickness between toner layers, which leads to occurrence of an uneven glossy. As a result, the color image formed on the plain paper or the coat paper such as the general printing paper makes an incident illumination light diffuse and appears poor in glossiness when visually observed.

In view of the above, as a color image forming method and apparatus capable of obtaining a color image exhibiting the satisfactory glossiness, a belt fixing device of a cool-peeling system is proposed, in which the toner images are superimposed on a belt with a high glossy surface and applied with heat and pressure, so that the toner is melted and cooled to be solidified. The solidified toner is peeled off and, the belt surface shape is replicated thereon to provide a high glossy image.

For example, a technique for increasing the glossiness by use of the belt fixing device of the cool-peeling system has been proposed up to now. Also, as the recording sheet on which the image is fixed by the belt fixing device, a recording sheet whose surface includes an image receiving layer has been proposed. Further, the image receiving layer with a suitable viscoelasticity has been proposed. The following technique has been conventionally proposed. That is, while the coat paper is used as the recording sheet, the image is fixed by applying a high pressure at a temperature not higher than a softening temperature of the coat layer.

Incidentally, as the recording sheet, there is one in which a receiving layer is additionally formed on a support member (coat paper) having base paper coated with a polyolefin resin. Such a recording sheet is preferable from the viewpoint of photo-like image formation. Meanwhile, the polyolefin resin in the recording sheet is generally low in heat resistance temperature, so that if a fixing operation is performed at a high temperature as disclosed in Patent Document 3, a blister or an offset of a polyolefin resin layer develops. On the other hand, in the case of the fixing operation at a low temperature as disclosed in Patent Document 4, an appearance of the obtained image is still step-like and thus, a photo-like, smooth image quality cannot be obtained. Also, taking into account a durability etc. of the apparatus, it is desirable that a fixing nip pressure be as low as possible.

OBJECT AND SUMMARY OF INVENTION

The present invention has been made in view of the above technical problems and provides a fixing device enabling both elimination of a step-like appearance of a toner image on a recording sheet and prevention of a blister in a resin layer of the recording sheet (by adjusting temperature conditions and/or pressure conditions upon the fixing process).

The present invention provides an relief smoothing apparatus that smoothes an image on a recording sheet which is obtained by forming a polyolefin resin coating layer on at least one side of a base sheet and forming a receiving layer, in which a toner image is infiltrated, on at least one side of the base sheet, including:

plural tension rolls including a first roll;

an endless belt stretched over the plural tension rolls in a rotatable manner;

a second roll that comes into press contact with a heating roll through the endless belt to form a nip portion; and a heating source that heats at least one of the first roll and the second roll, the recording sheet having the receiving layer side which is brought into close contact with the endless belt at the nip portion and is peeled off from the endless belt after being transported and cooled together with the endless belt, in which provided that a surface temperature of the first roll is represented by Tn [° C.], a Vicat softening temperature of the polyolefin resin is represented by Tv [° C.] (when the polyolefin resin coating layers formed on both sides of the base sheet are different from each other, a lower Vicat softening temperature is adopted as the Vicat softening temperature Tv), a time required for the recording sheet to pass through the nip portion is represented by t [sec], a pressure of the nip portion is represented by P [MPa], and the time required for the recording sheet to pass through the nip portion is represented by t [sec], at least one of the following conditions is satisfied.

The conditions are as follows:

(1): $(Tv+55)\times(1+1/100\ t)\geqq Tn$;

(2): $Tn\geqq(Tv+20)/(1+1/100\ t)$ [° C.];

(3): $0.50\geqq P\cdot t$ [MPa·s];

(4): $P\geqq 1.0$ [MPa];

(5): $t\geqq 0.1$ [sec];

(6): $0.05\leqq t$, preferably $0.01\leqq t$ [sec];

(7): t [sec]$\leqq 0.5$, preferably t [sec]$\leqq 0.25$, more preferably t [sec]$\leqq 0.20$;

(8): Tn [° C.]$\leqq 155$, preferably Tn [° C.]$\leqq 140$, more preferably Tn [° C.]$\leqq 135$;

(9): $105\leqq Tn$ [° C.], preferably $115<Tn$ [° C.], more preferably $120\leqq Tn$ [° C.]; and (10): $P\cdot t$ [MPa·s]$\geqq 0.10$.

Also, the apparatus may further include a cooling member that cools a region on a downstream side of the nip portion from inside the endless belt. Here, the cooling member is exemplified by a heat sink and a fan device adapted to make the air blow into the heat sink. Also, ducts are provided around the heat sink and the air can be made to blow into the ducts with the fan device.

Also, the relief smoothing apparatus may constitute (1) a belt-type fixing device or (2) a transfix type image forming apparatus. That is, (1) the relief smoothing apparatus having the endless belt that is a fixing belt may constitute a fixing device that fixes a toner image held on an image receiving layer side of the recording sheet or (2) the relief smoothing apparatus having the endless belt that is an intermediate transfer belt may constitute an image forming apparatus that transfers and fixes a toner image held on the intermediate transfer belt onto an image receiving layer side of a recording sheet. Further, also in the case where (1) the relief smoothing apparatus constitutes the belt-type fixing device, the image forming apparatus including the same can be provided. More specifically, the image forming apparatus can be provided, which includes a first fixing device and a second fixing device (belt-type fixing device) provided on a downstream side in a transport direction of the first fixing device with a first mode in which only the first fixing device performs a fixing process on a recording sheet and a second mode in which the first fixing device and the second fixing device perform the fixing process on the recording sheet.

BRIEF DESCRIPTION OF THE DRAWINGS

Preferred embodiments of the present invention will be described in detail based on the following figures, wherein.

DETAILED DESCRIPTION OF THE PREFERRED EMBODIMENT

Hereinafter, embodiments of the present invention will be described with reference to the figures.

[Image Forming Apparatus]

Figure 1:
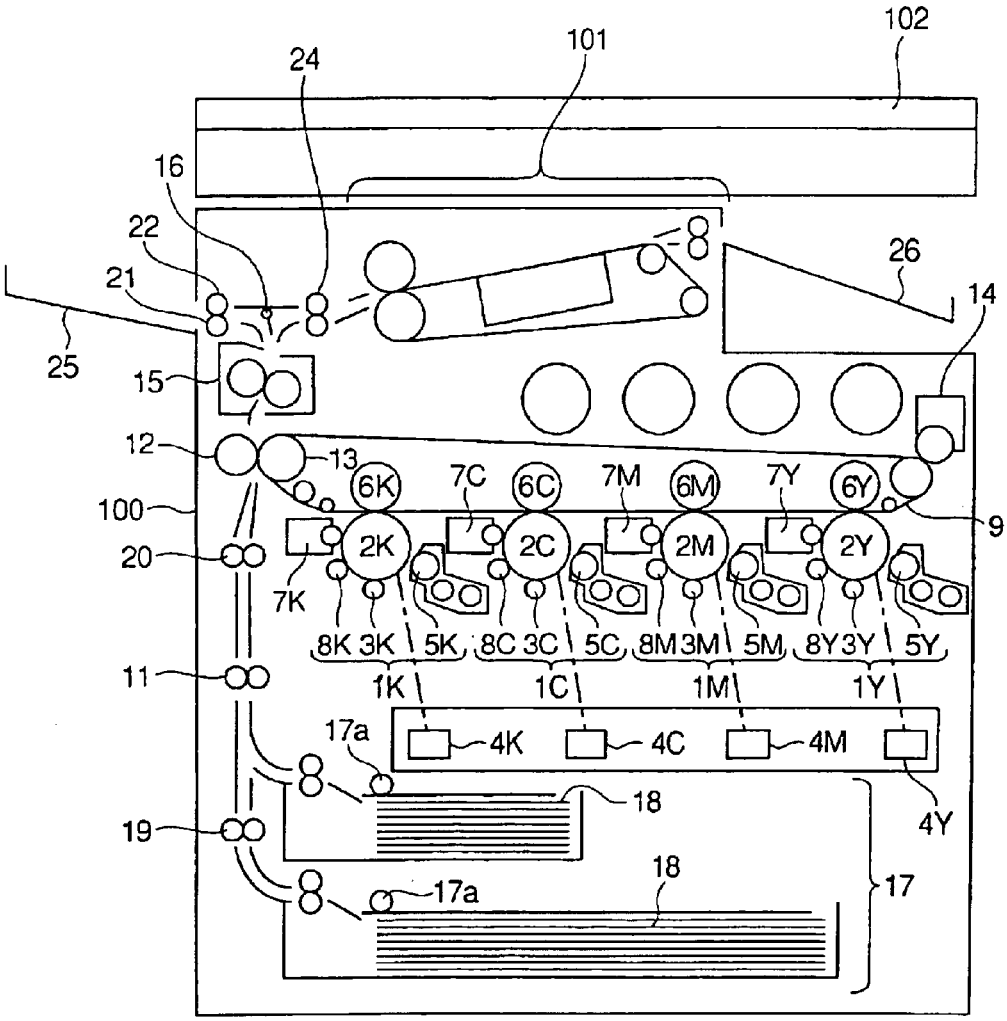
FIG. 1 is a schematic structural view showing an image forming apparatus in accordance with an embodiment of the present invention.

FIG. 1 is a schematic structural view of a tandem type color image forming apparatus 100 according to the present invention. Here, inputted to the image forming apparatus 100 are color image information sent from a personal computer or the like although not shown in FIG. 1 and color image information of a color original which is read out by an image reading apparatus 102, and image processing is performed on the inputted image information.

Reference symbols 1Y, 1M, 1C, and 1K respectively denote electrophotographic image forming units that form toner images in respective colors of yellow, magenta, cyan, and black. The image forming units 1Y, 1M, 1C, and 1K are arranged in the stated order in tandem in an advancing direction of an endless intermediate transfer belt 9 stretched by means of plural tension rolls 10. Also, the intermediate transfer belt 9 passes between electrostatic latent image bearing members 2Y, 2M, 2C, and 2K of the electrophotographic image forming units 1Y, 1M, 1C, and 1K and transfer units 6Y, 6M, 6C, and 6K arranged opposite thereto in one-to-one correspondence. A material for toner etc. will be described later.

Here, a description will be given of an image forming operation with respect to the intermediate transfer belt 9 while focusing on the electrophotographic image forming unit 1Y that forms a yellow toner image by way of example.

First, a surface of the electrostatic latent image bearing member 2Y is uniformly charged by a uniform charger 3Y. Next, image exposure is performed by an exposure device 4Y in correspondence with the yellow image. An electrostatic latent image corresponding to the yellow image is formed on the surface of the electrostatic latent image bearing member 2Y.

The electrostatic latent image corresponding to the yellow image is changed into the yellow toner image by a developing device 5Y and transferred onto the intermediate transfer belt 9 by a press-contact force of the primary transfer roll 6Y constituting part of a primary transfer unit and an electrostatically attracting force. A transfer residual yellow toner on the electrostatic latent image bearing member 2Y is scraped off of the member by an electrostatic latent image bearing member cleaning device 7Y. After being discharged by a discharger 8Y, the surface of the electrostatic latent image bearing member 2Y is recharged by the uniform charger 3Y for use in the next image forming cycle.

In the image forming apparatus 100 of the present invention which forms a multi-color image, at a timing that is set while considering a difference in relative position of the electrophotographic image forming units 1Y, 1M, 1C, and 1K, the same image forming step as the above is performed also in the electrophotographic image forming units 1M, 1C, and 1K, thereby forming a full-color toner image on the intermediate transfer belt 9.

The full-color toner image formed on the intermediate transfer belt 9 is transferred onto a recording medium 18 transported to a secondary transfer position at a predetermined timing by the press-contact force generated between a backup roll 13 that supports the intermediate transfer belt 9 and a secondary transfer roll 12 coming into press contact with the backup roll 13 and constituting part of a secondary transfer unit and by the electrostatically attracting force.

As shown in FIG. 1, the recording sheet 18 having a predetermined size is fed from a sheet feed cassette 17 as a recording medium receiving part arranged on a lower side in the image forming apparatus 100 by a sheet feed roll 17*a*. The recording sheet 18 thus fed is transported up to a secondary transfer position on the intermediate transfer belt 9 at a predetermined timing by plural transport rolls 19 and registration rolls 20. As described above, the full-color toner image is collectively transferred from the intermediate transfer belt 9 to the recording sheet 18 by the backup roll 13 and the secondary transfer roll 12 as the secondary transfer unit.

Also, the recording sheet 18 having the full-color toner image transferred thereonto from the intermediate transfer belt 9 is separated from the intermediate transfer belt 9, and then transported to a first fixing device 15 disposed on a downstream side of the secondary transfer unit. The toner images are fixed onto the recording sheet 18 through the application of heat and pressure by the first fixing device 15.

Here, the residual toner on the intermediate transfer belt 9 which the secondary transfer unit cannot transfer onto the recording sheet 18 is carried up to an intermediate transfer member cleaning device 14 as it is, i.e., in a state of adhering onto the intermediate transfer belt 9. The residual toner is thus removed from the intermediate transfer belt 9 by the cleaning unit 14 for use in the next image formation.

Figure 2:
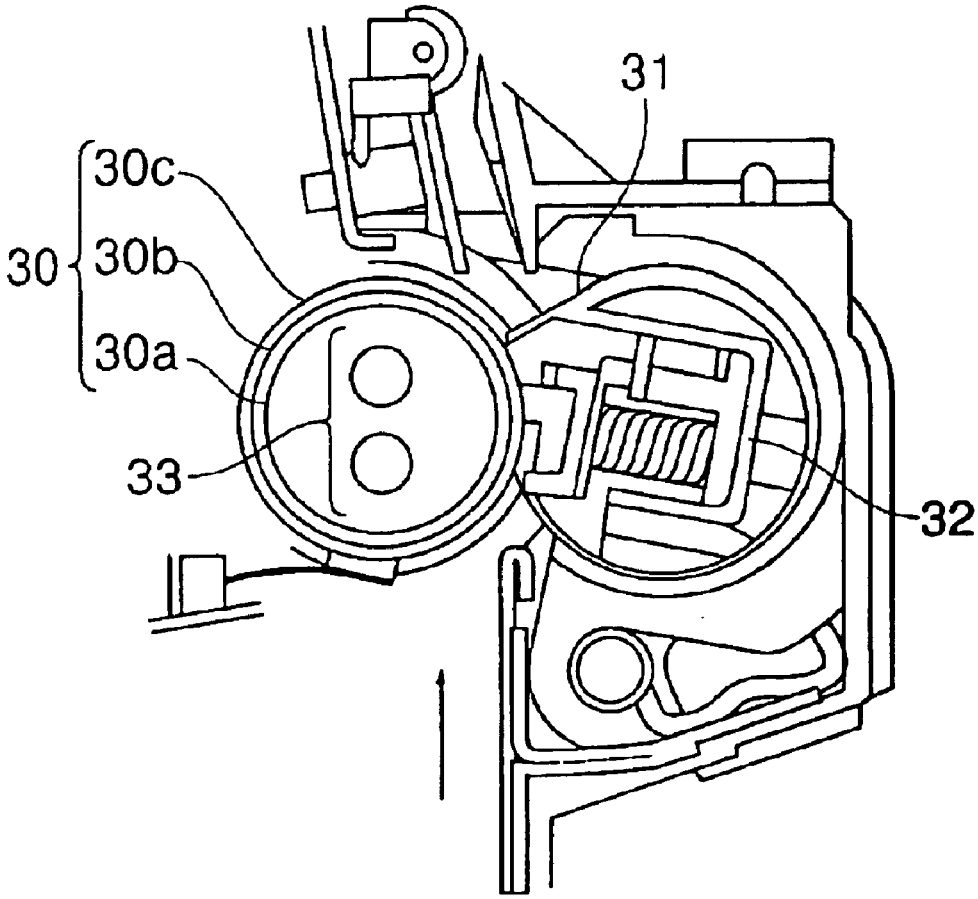
FIG. 2 is a schematic structural view showing a first fixing device.

FIG. 2 is a schematic sectional view illustrating the first fixing device 15. The first fixing device 15 is a pressure belt type fixing device composed of a fixing roll 30 with a small heat capacity, a pressure belt 31, and a pressure pad 32.

The fixing roll 30 is formed such that a surface of a core 30*a* is coated with an elastic member layer 30*b* made of silicone rubber having a rubber hardness (JIS-A) of 33° with a thickness of 0.5 mm and a length of 320 mm, the core 30*a* being made of aluminum and having a thickness of 1.5 mm, an outer diameter of 25 mm, and a length of 380 mm. Further, a releasing layer 30*c* constituted of a PFA tube having a thickness of 30 $\mu$m covers the surface of the elastic member layer 30*b*. A halogen lamp 33 with a power of 650 W is disposed inside the fixing roll 30 as a heating source. The halogen lamp heats the fixing roll 30 from the inside such that a surface temperature thereof reaches a predetermined temperature (in general, 140 to 190° C. although depending on a temperature at which the toner is melted).

The pressure belt 31 is a polyimide belt having a thickness of 75 $\mu$m, an outer diameter of 30 mm, and a length of 330 mm. In addition, a releasing layer constituted of the PFA tube with a thickness of 30 $\mu$m is formed on the polyimide belt surface. The pressure pad 32 adapted to pressurize the pressure belt 31 against the fixing roll 30 to form a nip is arranged inside the pressure belt 31. The pressure pad 32 gives a press load of 33 Kg and has a nip width of 6.5 mm. The heat source is not provided on the side of the pressure belt 31 and the pressure pad 32.

A recording medium transport path 11 inside the image forming apparatus 100 of the present invention extends on a side surface of the image forming apparatus 100 in a substantially vertical form.

With the substantially vertical recording medium transport path 11, the recording sheet 18 after the image formation and the image fixing can be delivered onto an upper portion of the image forming apparatus. Thus, a second fixing device 101 can be disposed between the image forming apparatus 100 and the image reading apparatus 102 without providing an additional recording medium transport path.

The image forming apparatus 100 of the present invention adopts a first mode (general print) and a second mode (high glossy print, i.e., photograph mode). When the general print mode is selected, which is used for outputting an image with a low glossiness or no glossiness), the sheet is selectively fed from the sheet feed cassette 17 receiving the plain paper and the coat paper. The full-color toner image is transferred thereonto by the secondary transfer unit and fixed by the first fixing device 15. After that, the transport path is switched to a first recording medium delivery port 21 side by a transport direction switching gate 16. Thus, the sheet is delivered onto a plain paper mode delivery tray 25 by a delivery roll 22 with the image formed surface up.

Figure 3:
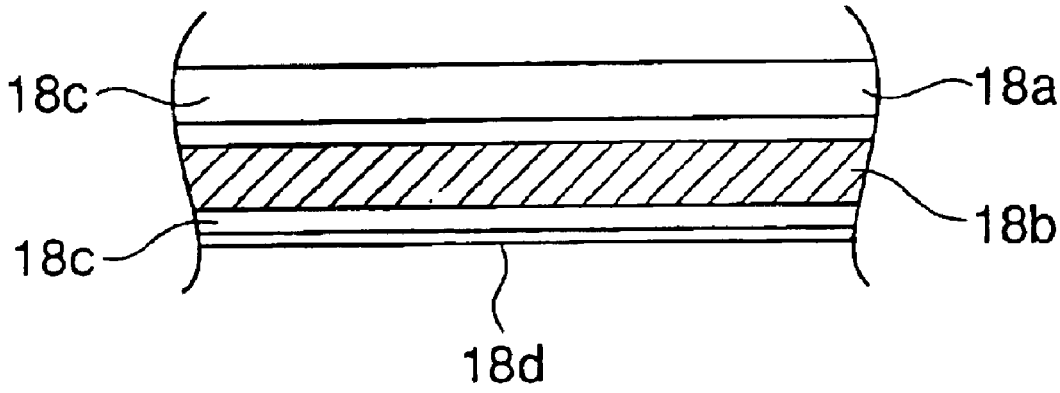
FIG. 3 is a schematic structural view of a recording sheet.

Next, referring to FIG. 3, the recording sheet 18 will be described in detail, which is used when the second mode is selected in this embodiment. The recording sheet 18 has a base sheet 18*b* both sides of which are coated with polyolefin resin coating layers 18*c* and one side of the polyolefin resin coating layer 18*c* is coated with a transparent image receiving layer (transparent resin layer; receiving layer) 18*a* mainly containing a thermoplastic resin such as polyester with a thickness of 5 to 20 $\mu$m (e.g., with a thickness of 10 $\mu$m). With the above recording sheet 18, the entire surface achieves the uniform glossiness. Note that, materials for the base sheet 18*b*, the polyolefin resin coating layer 18*c*, and the image receiving layer 18*a* will be mentioned later.

Figure 4:
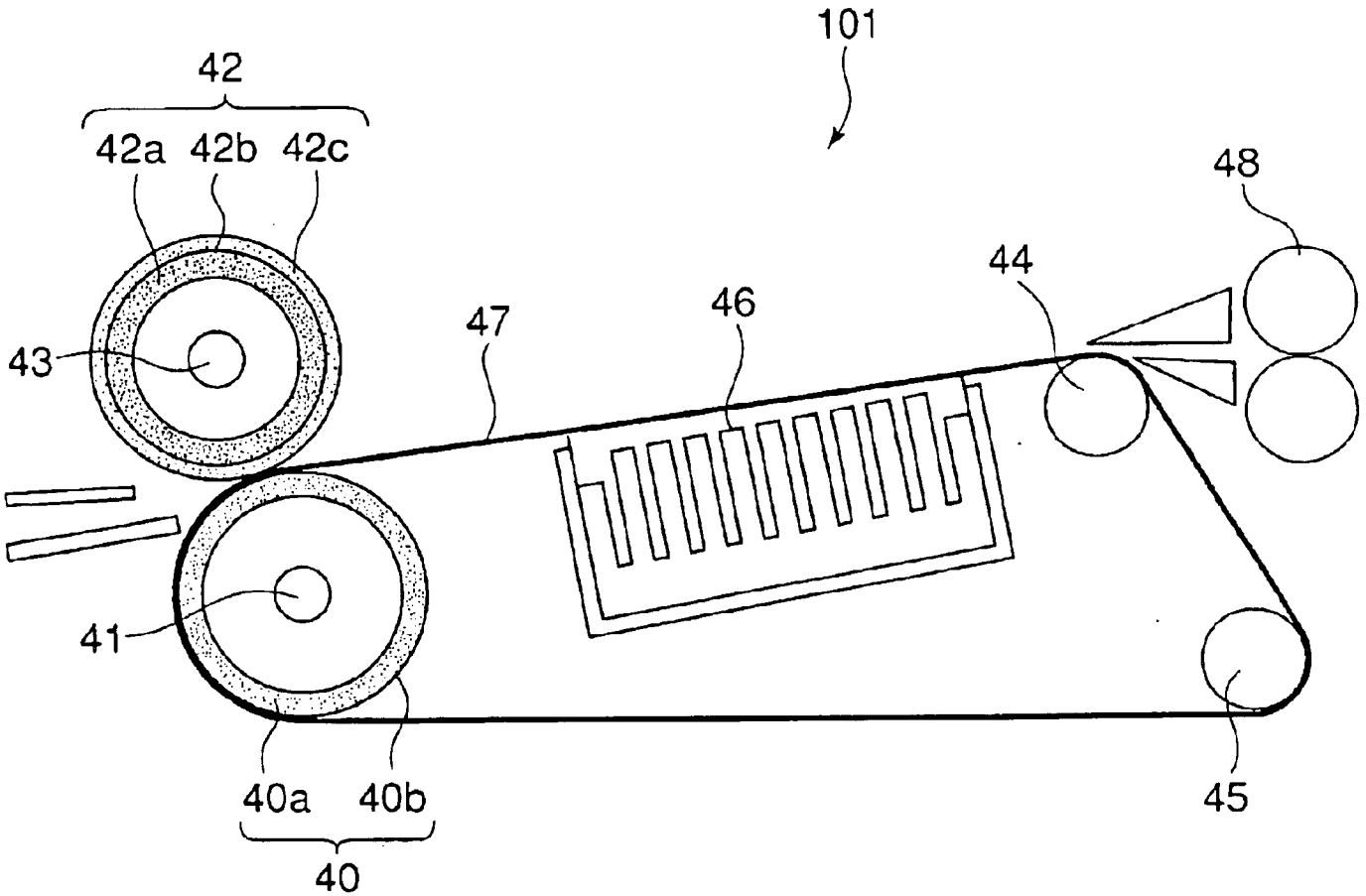
FIG. 4 is a schematic structural view showing a second fixing device.

Hereinafter, referring to FIGS. 4 and 5, the second fixing device (fixing device) 101 will be described in detail, which is used when the second mode is selected.

As shown in FIG. 1, the second fixing device 101 is disposed between the image forming apparatus portion and the image reading apparatus 102 and integrated with the image forming apparatus 100.

The second fixing device 101 as a belt fixing device includes: a heat fixing roll (first roll) 40 having a heat source; a peeling roll (tension roll) 44; a steering roll (tension roll) 45; a fixing belt (endless belt) 47 that winds around the heat fixing roll 40, the peeling roll 44, and the steering roll 45; a pressure roll (second roll) 42 that is pressed against the heat fixing roll 40 through the fixing belt 47 to form a nip portion; and a heat sink (cooling part) 46 that cools the fixing belt 47 on the downstream side of the nip portion in a rotating direction of the fixing belt 47. The belt fixing device is structured as follows. The recording sheet 18 having the toner born thereon is transported to the nip portion such that the toner image comes into contact with the fixing belt 47, followed by fixing the image through the application of the heat and the pressure. After being cooled by the cooling device (cooling part) 46, the fixing belt 47 and the recording sheet 18 are peeled off from each other.

The heat fixing roll 40 has a metal core 40*a* having a high heat conductivity, whose surface is coated with a releasing layer 40*b* constituted of a fluororesin layer of the PFA tube etc. Further, a heating source (heat source) 41 such as a halogen lamp is provided inside the core 40*a* and heats the heat fixing roll 40 such that a surface temperature thereof reaches a predetermined temperature. Thus, the fixing belt 47 and the recording sheet 18 having the toner image formed thereon are heated.

The pressure roll 42 has a metal core 42*a* having a high heat conductivity, whose periphery is coated with an elastic member layer 42*b* made of silicone rubber having a rubber hardness (JIS-A) of about 40°. Further, a releasing layer 42*c* constituted of a fluororesin layer of the PFA tube etc. is formed on the elastic member layer 42*b* surface. A heating source (heat source) 43 such as a halogen lamp is provided inside the core 42*a* and heats the pressure roll 42 such that a surface temperature thereof reaches a predetermined temperature. Thus, the recording sheet 18 is applied with the pressure upon the fixing process and at the same time, the recording medium is heated from the rear side.

The structures of the heat fixing roll 40 and the pressure roll 42 are not limited to the foregoing ones, but maybe any structures as long as the toner image formed on the recording sheet 18 can be fixed onto the recording sheet 18 through the fixing belt 47. A non-rotational planar (heat generating) heater can replace the heat fixing roll 40. Also, instead of using the pressure roll, either a combination of a fixation member and an endless belt or a combination of a roll and an endless belt may be used.

The peeling roll 44 is based on the principle that the recording sheet 18 peels off from the fixing belt 47, owing to its own rigidity. An outer diameter size (dimension) is defined according to an adhesion of the fixing belt 47 and the recording sheet 18 to each other and angle at which the fixing belt 47 winds around the peeling roll 44. The steering roll 45 serves to prevent the breakage of belt end portions which occurs by the fixing belt 47 rotating off-center. One axis of the steering roll is fixed, whereas the other axis is inclined with respect to the heat fixing roll 40 by a drive device (now shown). Therefore, when the fixing belt 47 rotates off-center, the steering roll functions to change the advancing direction of the belt to the direction opposite to the off-center direction.

The heat sink 46 is adapted to cool the recording sheet 18 in close contact with the fixing belt 47 and disposed on an inner peripheral surface of the fixing belt 47 and on the downstream side of the heat fixing roll 40 but on the upstream side of the peeling roll 44. The heat sink comes into contact with the inner peripheral surface of the fixing belt to absorb the heat of the fixing belt. The heat sink 46 cools the image receiving layer 18*a* constituting the recording sheet 18 surface and the toner image thereon melted by the heat fixing roll 40 and the pressure roll 42. The entire image surface is solidified in a smooth form according to the fixing belt 47 surface, thereby enabling the high glossy print.

As the fixing belt 47, a belt is adopted, in which a silicone rubber layer or the like with a thickness of 35 $\mu$m and a smooth surface covers an endless film made of thermosetting polyimide. From the viewpoint of power consumption, the thin belt is desirable, but a polyimide base material should have a thickness of 75 $\mu$m or more in terms of strength etc., and the silicone rubber layer should have a thickness of 30 $\mu$m or more in terms of close contact with the toner image on the recording medium for the fixing. Further, the fixing belt 47 is stretched between the heat fixing roll 40, the peeling roll 44, and the steering roll 45, and rotated in accordance with the rotation of the heat fixing roll 40.

Next, a description will be given of an operation from the image formation to the delivery and a transport path when the second mode is selected.

Also when the second mode is selected, similarly to the case of selecting the first mode, the above-mentioned image forming process is carried out, thereby forming the full-color toner image on the intermediate transfer belt 9. At this point, the sheet is selectively fed from the sheet feed cassette 17 receiving the recording sheet 18 of the second mode and the full-color toner image is transferred by the secondary transfer unit and fixed in the first fixing device 15. After that, the transport path is switched to the second fixing device 101 side by the transport direction switching gate 16, thereby transporting the sheet to the second fixing device 101 side by a transport roll 24.

Figure 5:
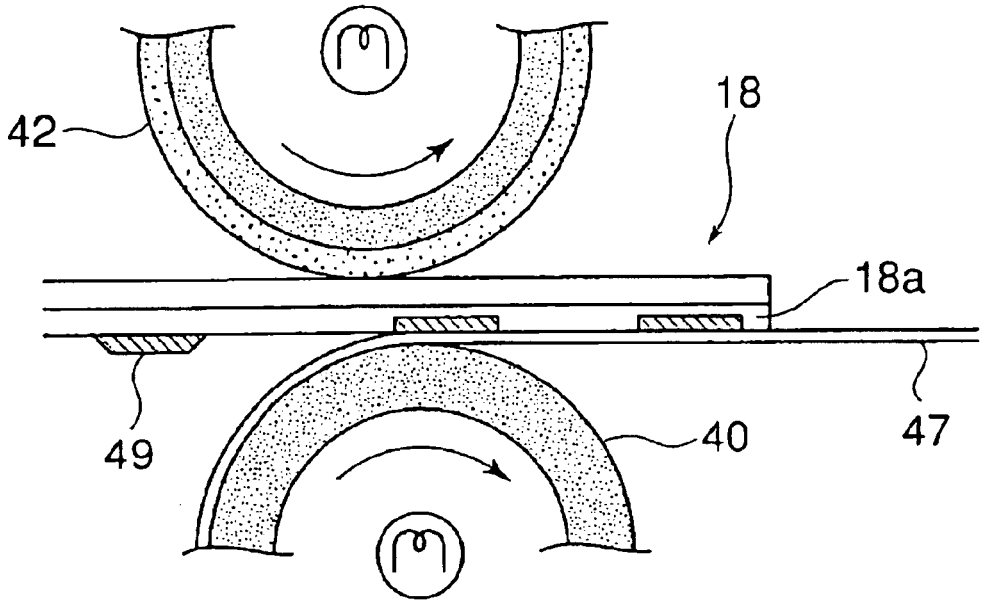
FIG. 5 shows a second mode process of the second fixing device.

As shown in FIG. 5, a toner 49 held to the image receiving layer 18*a* side of the recording sheet 18 is infiltrated into the image receiving layer 18*a* by the fixing belt 47 wound around the heat fixing roll 40 of the second fixing device 101 and the pressure roll 42. Then, the sheet is transported in close contact with the fixing belt 47 and cooled down to the predetermined temperature by the heat sink 46. Thereafter, the recording sheet 18 peels off from the fixing belt 47 at the peeling roll 44 and is delivered by a delivery roll 48 onto a second mode delivery tray 26 with the image formed surface down.

The toner 49 on the recording sheet 18 transported to the second fixing device 101 has once undergone the fixing process by the first fixing device 15 disposed inside the image forming apparatus 100. Therefore, when the transport direction switching operation is performed by the transport direction switching gate 16, even if the image formed surface is brought into contact with a transport support member etc., any image quality defect such as an image disturbance by no means occurs.

Figure 6:
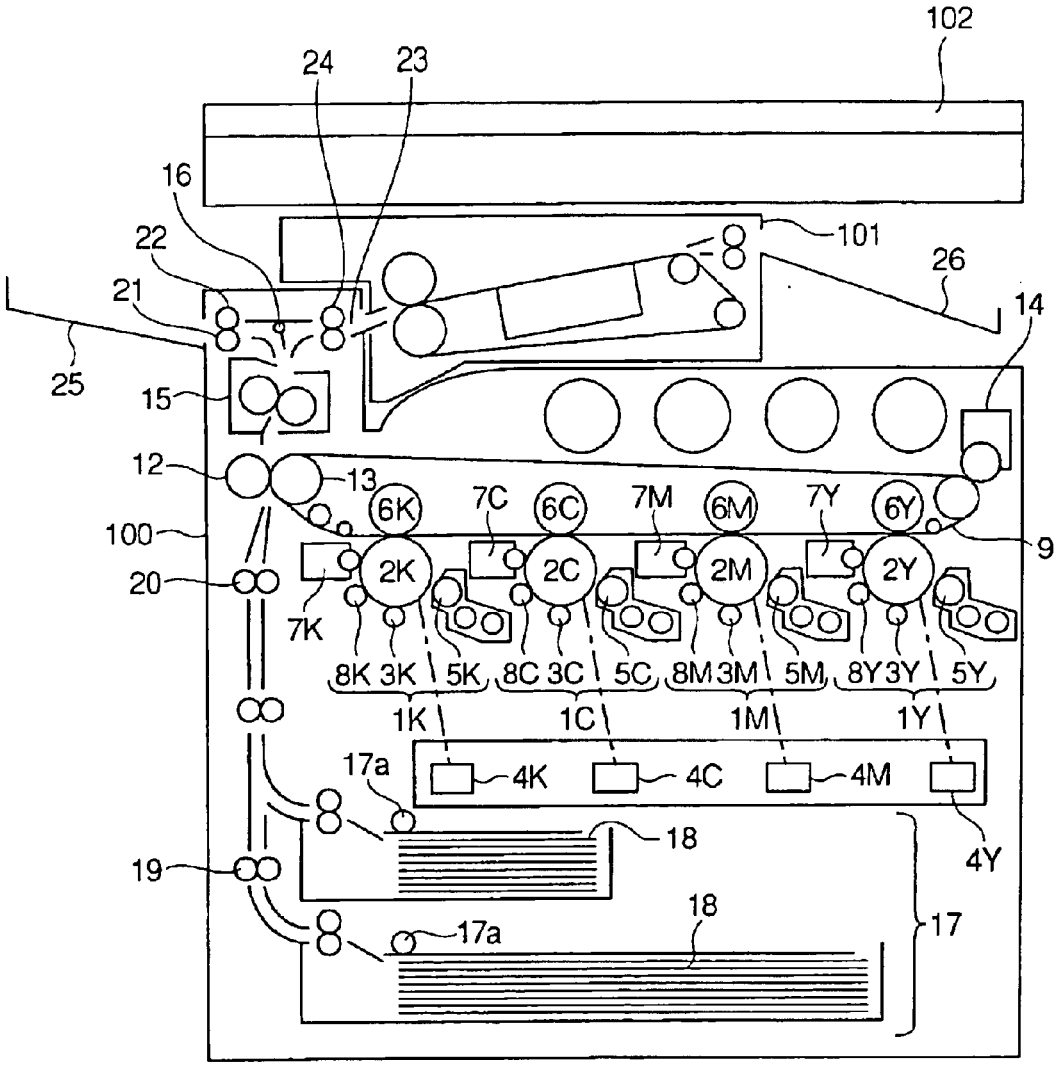
FIG. 6 is a schematic structural view showing an image forming apparatus in accordance with another embodiment of the present invention.

Note that, although in this embodiment, the second fixing device 101 is integrated with the image forming apparatus 100, the present invention is not limited thereto. As shown in FIG. 6, the second fixing device 101 and the image forming apparatus 100 may be structured as different units.

More specifically, as shown in FIG. 6, the second fixing device 101 used in the second mode constitutes a unit different from the image forming apparatus 100 and is disposed on the downstream side of the first fixing device 15 inside the image forming apparatus 100 in the recording medium transport direction and disposed between the image forming apparatus 100 and the image reading apparatus 102.

The second fixing device 101 is formed as the separate unit, and thus can be attached to the existing image forming apparatus adopting only the general print mode. As a result, the image forming apparatus capable of outputting the image with the high-glossiness (photographic image) and the image with no glossiness (general text format etc.) can be obtained without any additional development on an image forming apparatus main body.

Figure 7:
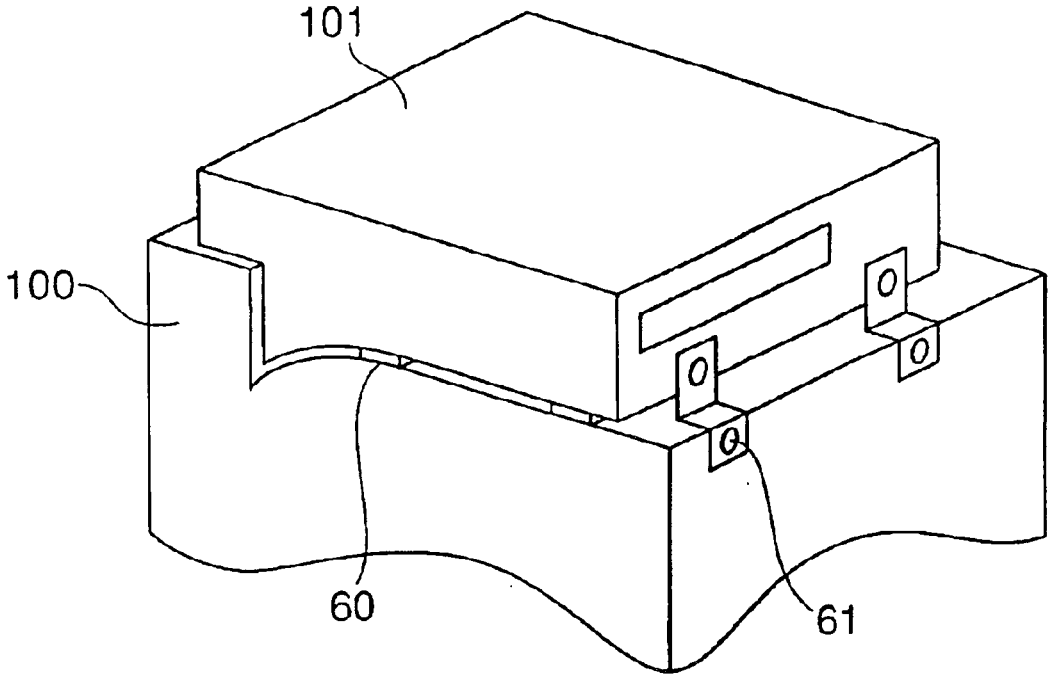
FIG. 7 shows an arrangement method for a second fixing device of the image forming apparatus of FIG. 6.
Figure 8:
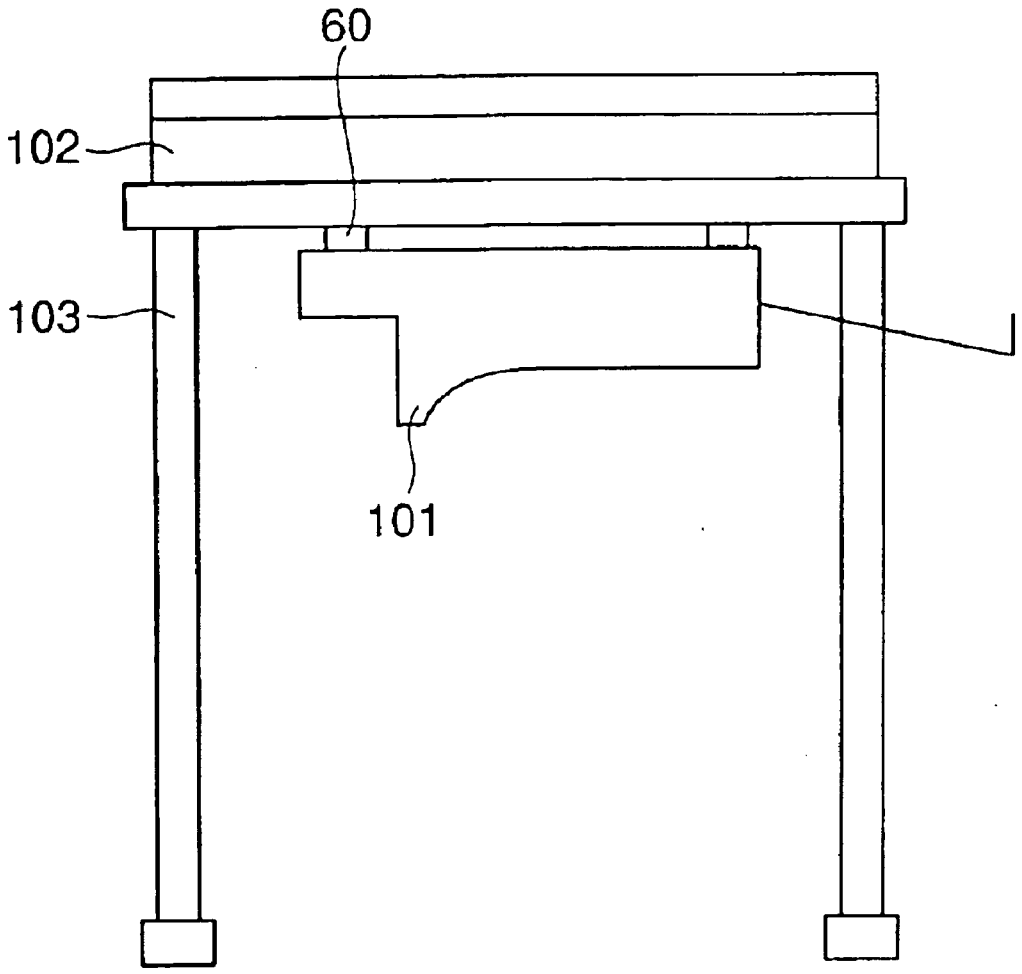
FIG. 8 shows another arrangement method for the second fixing device of the image forming apparatus of FIG. 6.

The second fixing device 101 is disposed as follows. That is, as shown in FIG. 7, plural support members 60 and plural fixing members 61 are provided on the bottom or side surface of the second fixing device 101 and the device is directly mounted on the image forming apparatus 100. Alternatively, as shown in FIG. 8, the plural support members 60 are provided on the upper or side surface of the second fixing device 101 and the device is hung on the bottom portion of the image reading apparatus 102 or an image reading apparatus attachment member 103 or the like, which supports the image reading apparatus 102.

Experiment 1

In the image forming apparatus 100 thus structured, the following experiment was performed for specifying appropriate temperatures of the heat fixing roll 40 and the pressure roll 42 and a heating member temperature Tn.

First, experimental conditions are described. With regard to a more detailed structure of the second fixing device 102, the heat fixing roll 40 is structured as an aluminum hard roll having a diameter ϕ of 50 mm and the pressure roll 42 is structured as an elastic roll having a diameter ϕ of 50 mm (rubber layer: 2 mm). Also, a width (nip width) of the nip portion formed between the heat fixing roll 40 and the pressure roll 42 (to be specific, the nip portion between the fixing belt 47 and the pressure roll 42) in the transport direction is 6.0 mm. Also, a nip pressure is 1.5 MPa. Further, adopted as the fixing belt 47 is one having a polyimide base material with a thickness of 75 μm coated with the silicone rubber layer having a thickness of 35 μm. Also, the polyolefin resin coating layer 18*c* of the recording sheet 18 has a Vicat softening temperature Tw of 86° C., which is the same as that of low density PE. In addition, a fixing rate is 60 mm/s.

As the experimental method, while changing the heating member temperature Tn, the toner image was fixed onto the recording sheet 18, and confirmation was made of relief (step) conditions of the fixed image and of whether or not the blister and the offset of the polyolefin resin coating layer 18*c* occurred.

Figure 9:
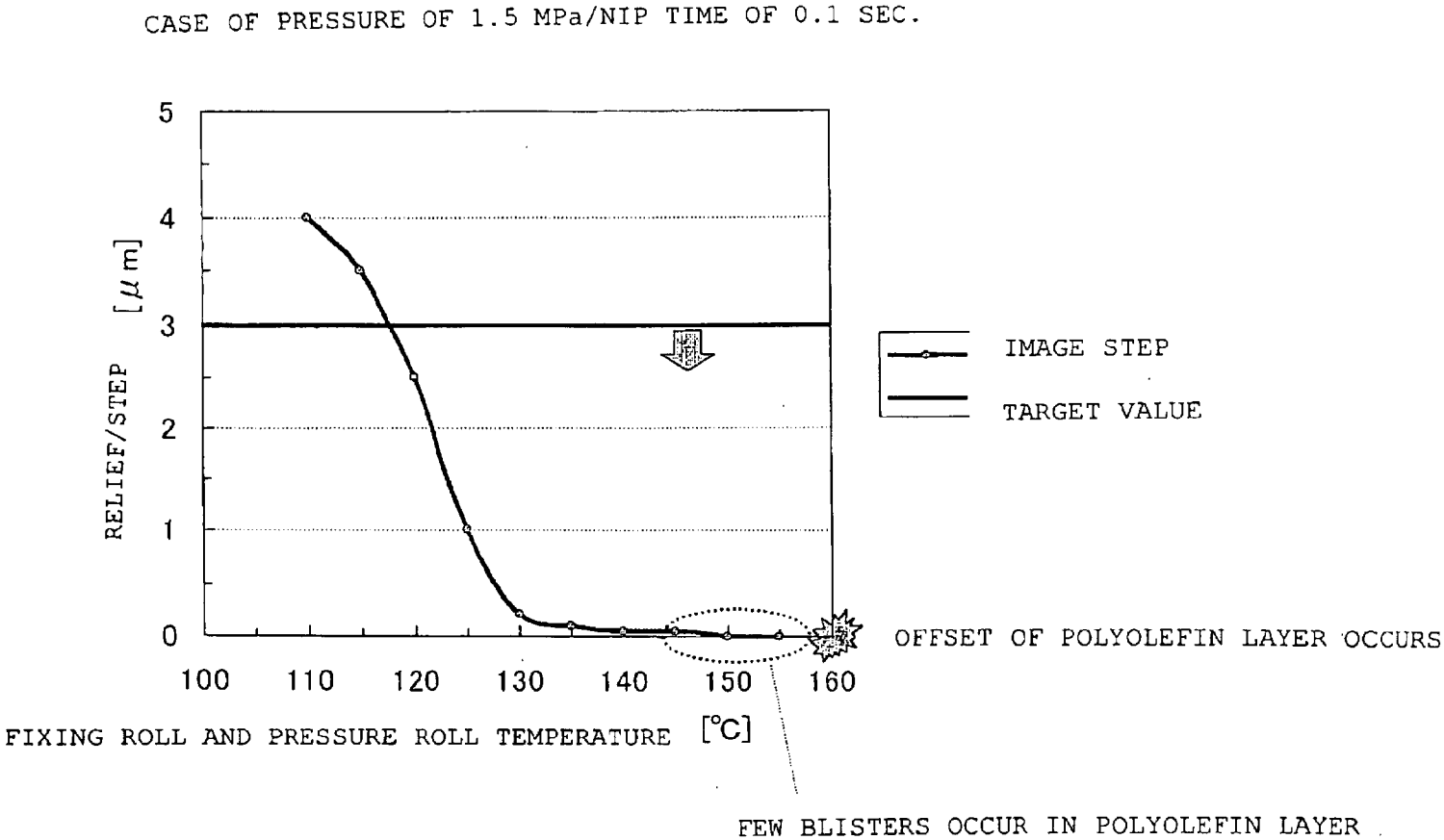
FIG. 9 is a graph showing an experimental result regarding an image step (relief) of the present invention.

FIG. 9 is a graph illustrating the experimental result in the case where a nip time is 0.1 sec. The vertical axis represents the relief size and the horizontal axis represents the heating member temperature Tn. If forcusing on the low temperature side of the heating member temperature Tn, infiltrating property is poor at the heating member temperature of less than 110° C. On the other hand, if forcusing on the high temperature side of the heating member temperature Tn, the polyolefin resin coating layer 18*c* of the recording medium is overmelted at the heating member temperature of 155° C. or higher. As a result, a defect such as an offset of the entire surface occurs.

Accordingly, since a few blisters take place at the heating member temperature of 145° C. or higher, it is desirable that the heating member temperature Tn be set to less than 145° C.

Figure 10:
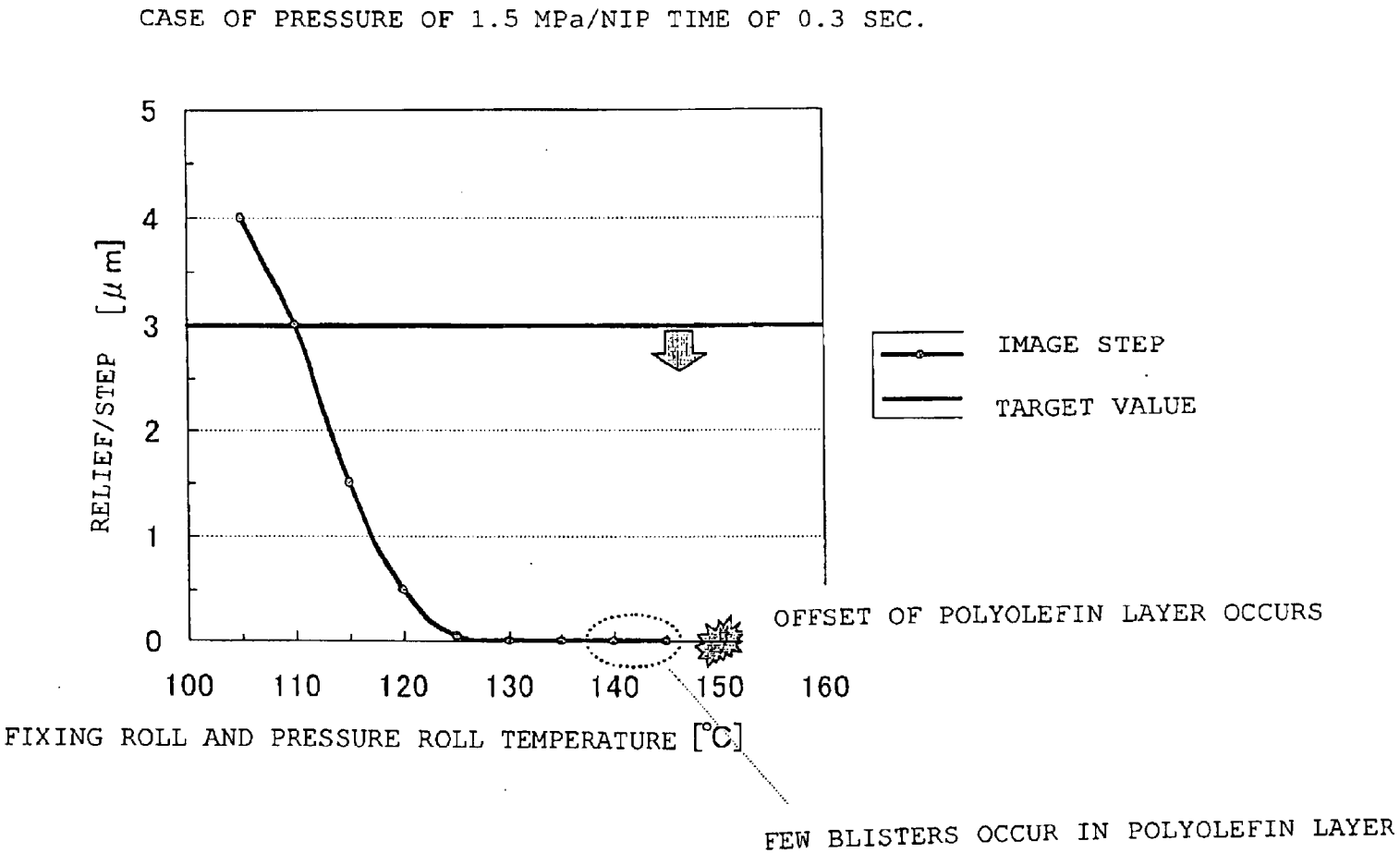
FIG. 10 is a graph showing an experimental result regarding an image step (relief) of the present invention.

FIG. 10 is a graph illustrating the experimental result in the case where a nip time is 0.3 sec. If the fixing rate is lowered and the time required for the sheet to pass through the nip portion is extended, the graph is wholly shifted to the low temperature side (left-handed side in FIGS. 9 and 10). As apparent from the fact, it is preferable to meet the relationship of $(Tv+55)\times(1+1/100\ t)\geqq Tn\geqq(Tv+20)/(1+1/100\ t)$ [° C.] (t: time required for the sheet to pass through the nip portion, Tv: Vicat softening temperature of the polyolefin resin, and Tn: heating member temperature). Here, the heating member temperature Tn desirably meets the temperature conditions of 117° C. to 155° C. at 0.1 s (refer to FIG. 9) and of 110° C. to 146° C. at 0.3 s (refer to FIG. 10). More preferably, $(Tv+45)\times(1+1/100\ t)\geqq Tn\geqq(Tv+20)/(1+1/100\ t)$ [° C.] (t: time required for the sheet to pass through the nip portion, Tv: Vicat softening temperature of the polyolefin resin, and Tn: heating member temperature) is satisfied. Here, the heating member temperature Tn desirably meets the temperature conditions of 117° C. to 144° C. at 0.1 s and of 110° C. to 135° C. at 0.3 s. Note that in the case where the polyolefin resin layers on the front side and the rear side of the recording sheet 18 differ in the Vicat softening temperature, the temperature range is defined on the basis of the lower Vicat softening temperature.

Experiment 2

Next, in the image forming apparatus 100 thus structured, the following experiment was performed for specifying an appropriate nip pressure P generated between the heat fixing roll 40 and the pressure roll 42 and time t required for the sheet to pass through the nip portion. The experimental condition and method are almost the same as in Experiment 1.

Figure 11:
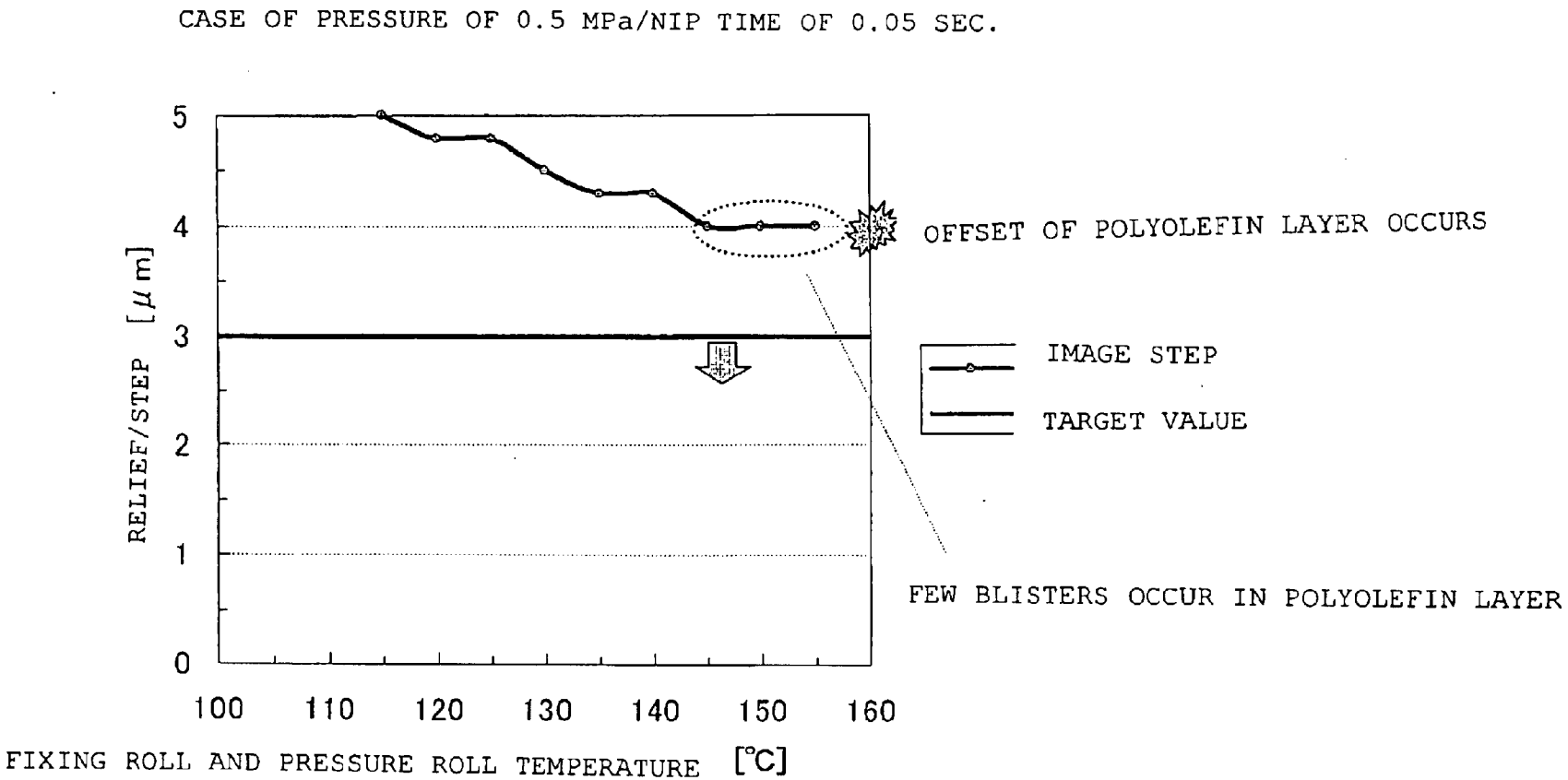
FIG. 11 is a graph showing an experimental result regarding an image step (relief) of the present invention.
Figure 12:
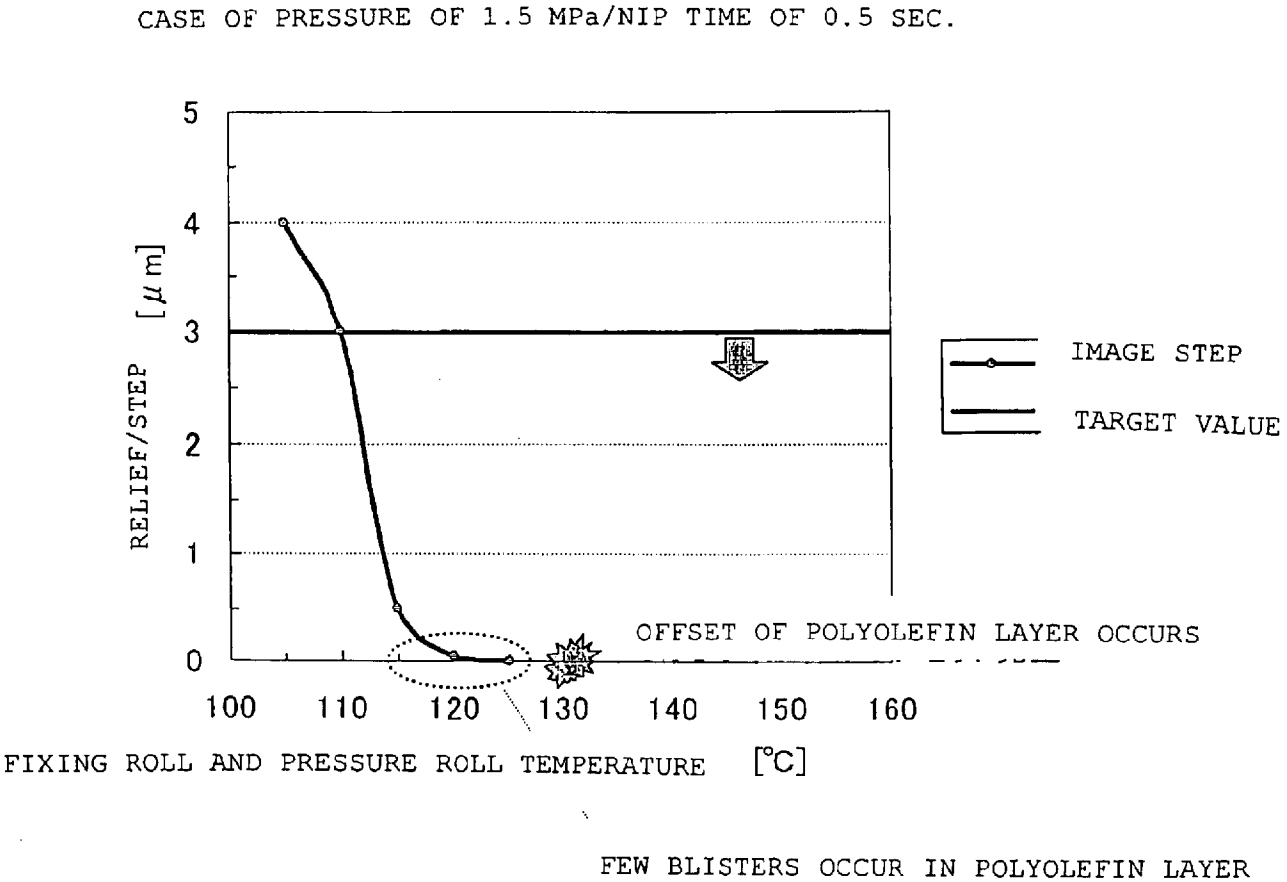
FIG. 12 is a graph showing an experimental result regarding an image step (relief) of the present invention.

FIG. 11 and FIG. 12 are graphs illustrating the experimental results in the case where the nip pressure P is 0.5 MPa and the nip time t is 0.05 sec and where the nip pressure P is 1.5 MPa and the nip time t is 0.5 sec, respectively. The vertical axis represents the relief size and the horizontal axis represents the heating member temperature Tn in each graph.

From those experimental results, the nip pressure and the time required for the sheet to pass through the nip portion preferably meet the following relationships: $0.50\geqq P\cdot t$ [MPa·s]$\geqq 0.1$, $P\geqq 1.0$ [MPa], and $t\geqq 0.1$ [s] (P: nip pressure and t: time required for the sheet to pass through the nip portion). Here, when both are equal to or smaller than the above set values (pressure: 0.5/time: 0.05 s), a temperature region where the target value is reached is not existent even if the temperature is increased (refer to FIG. 11). Even when either the pressure P or the time t increases, the satisfactory results cannot be obtained, so that both of them need to increase. However, the product of P·t is 0.5 or more, which is undesirable because the temperature at which the offset/blister occurs is lowered (refer to FIG. 12).

In this embodiment, the unfixed toner image is formed on a transfer sheet and temporarily fixed by the first fixing device, and then fixed by the second fixing device of the belt cool-peeling system. However, the present invention is not limited thereto but may take (1) a structure where the unfixed toner image is formed on the transfer sheet, and then fixed by the fixing device of the belt cool-peeling system or (2) a thermal transfix system where the unfixed toner image formed on the intermediate transfer belt is simultaneously subjected to the fixing process and the transfer, and then cooled to peel off from the intermediate transfer belt.

Figure 13:
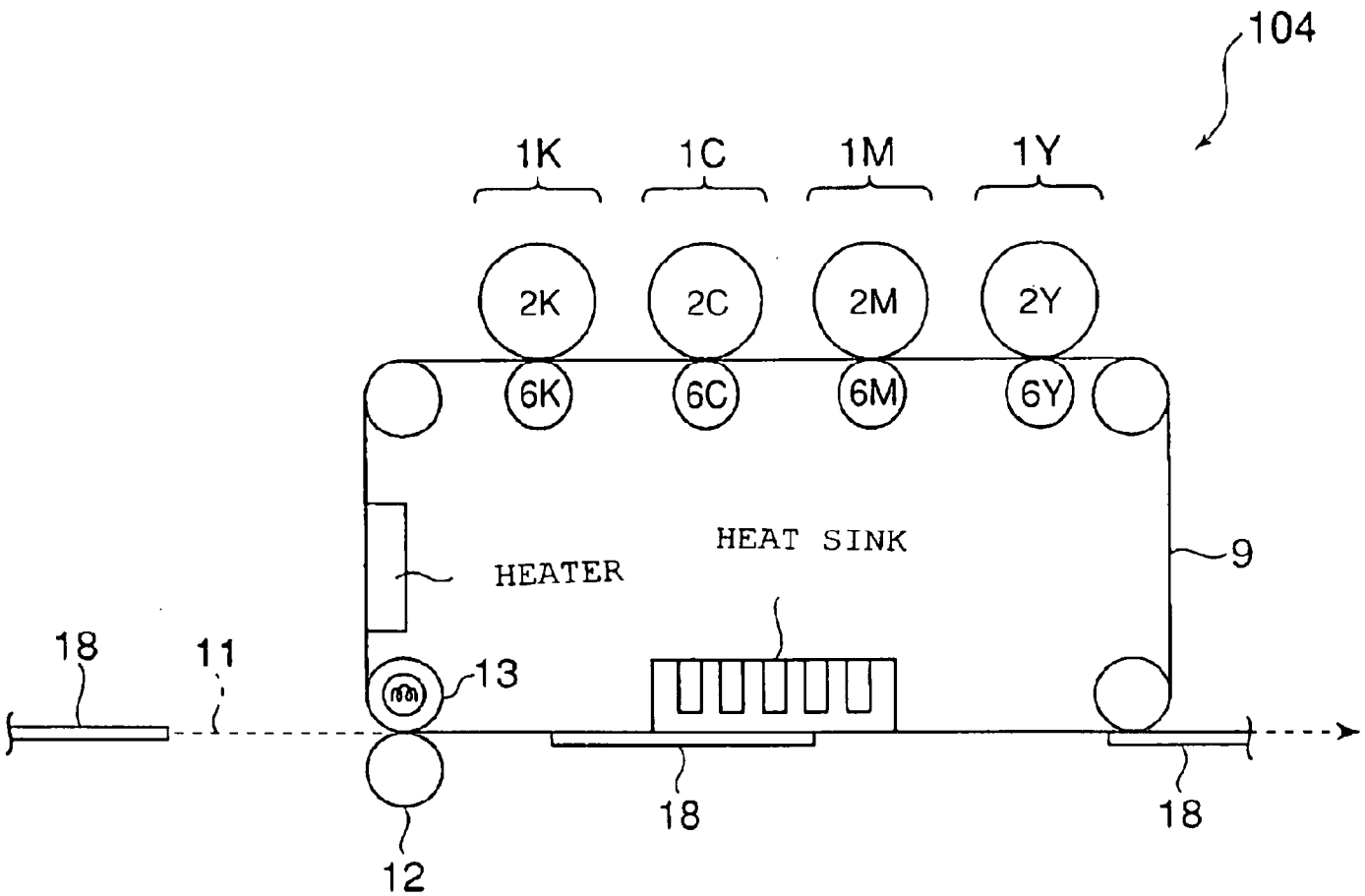
FIG. 13 shows a case of applying the present invention to an image forming apparatus of a thermal transfix system.

FIG. 13 shows a case of applying the present invention to an image forming apparatus 104 of the thermal transfix system. The same components as those of the image forming apparatus 100 according to the embodiment are indicated by the same reference symbols and a detailed description thereof is omitted here. An image forming operation of the image forming apparatus 104 is described. The toner images are superimposed on the intermediate transfer belt 9 in order from the image forming units 1Y to 1K by means of the primary transfer rolls 6Y to 6K. Finally, the full-color toner image is formed on the intermediate transfer belt 9. The full-color toner image on the intermediate transfer belt 9 is heated by a heater, and is simultaneously transferred and fixed onto the transported recording sheet 18 at the secondary transfer position by the action of heat and pressure. Note that the heat source is provided inside the backup roll 13 as well.

The recording sheet 18 is transported along with the rotation of the belt 9 while the image receiving layer 18*a* thereof comes into close contact with the intermediate transfer belt 9. At the time, the sheet is cooled by the heat sink. Then, the recording sheet 18 peels off due to its own rigidity at a portion where the intermediate transfer belt 9 changes its curvature. Thus, the image formation is completed.

[Material for Recording Sheet]

Incidentally, in the recording sheet 18, the base sheet as the support member of the sheet 18 desirably has an improved internal bonding strength. For improving the internal bonding strength of the base sheet 18*b*, various methods are conceivable, which can be appropriately selected according to its application, such as the addition of an appropriate kind of pulp for the base sheet (softwood pulp with a high rigidity), a heat-treated pulp, and a paper strength additive (polyamide, acrylamide, and amine compounds) or a wet paper strengthening agent (polyamide, epoxy, and melamine compounds) capable of accelerating beating and strengthening an interfiber bond; and the impregnation or application of an aqueous resin (polyvinyl alcohol, fluororesin, acrylic resin, styrene, acrylic-styrene copolymer, amide, urethane, and epoxy compounds) by size press.

The image receiving layer 18*a* also has a feature in that the glossiness is uniform in a recorded image portion. At the time of fixing the toner image, if the toner is not infiltrated into the recording sheet 18, the glossiness varies depending on the toner thickness, thereby remarkably degrading the image quality.

Thus, to eliminate the uneven glossy, it is important to infiltrate the toner into the image receiving layer 18*a*. That is, for infiltrating the toner into the layer, it is necessary that the toner is enough melted with the heat application in a short time and the resin constituting the image receiving layer 18*a* is softened to be mixed with the toner.

As a result of extensive studies on the above, the recording sheet 18 is formed such that a viscosity and an elasticity of the thermoplastic resin constituting the image receiving layer 18*a* of the recording sheet 18 are smaller than those of the color toner at the temperature of the inside of the fixing nip portion of the toner image formed of the color toner (e.g., 120 to 130° C.), so that the toner image formed of the color toner can be infiltrated into the image receiving layer 18*a* at the fixing time to minimize graininess of the image, thereby improving the glossiness.

Also, the above recording sheet 18 is formed such that a mechanical loss tangent (tan δ) of a dynamic viscoelasticity of the thermoplastic resin constituting the image receiving layer 18*a* of the recording sheet 18 is larger than a mechanical loss tangent (tan δ) of a dynamic viscoelasticity of the color toner at the temperature of the inside of the fixing nip portion of the toner image formed of the color toner (e.g., 120 to 130° C.), so that the toner image formed of the color toner can be infiltrated into the image receiving layer 18*a* at the fixing time to minimize the graininess of the image, thereby improving the glossiness.

In the recording sheet 18 according to this embodiment, for example, to satisfy the viscoelastic characteristics, a molecular weight of the thermoplastic resin constituting the image receiving layer 18*a* is set lower than that of the color toner.

Also, in the recording sheet 18 according to this embodiment, for example, to satisfy the viscoelastic characteristics, an addition amount of inorganic fine particles of the thermoplastic resin constituting the image receiving layer 18*a* is set smaller than that of inorganic fine particles of the color toner.

Examples of the resin constituting the image receiving layer 18*a* include a polyester resin, a styrene-acrylate resin, and a styrene-methacrylate resin. Of those, the polyester resin is particularly preferred for use. Given below are examples of a polyalcohol component and a polycarboxylic acid component of the polyester resin.

Examples of the polyalcohol component that may be used include ethylene glycol, propylene glycol, 1,4-butanediol, 2,3-butanediol, diethylene glycol, triethylene glycol, 1,5-pentanediol, 1,6-hexanediol, neopentylene glycol, 1,4-cyclohexanedimethanol, dipropylene glycol, polyethylene glycol, polypropylene glycol, and a monomer having bisphenol A added with olefin oxide.

Examples of the polycarboxylic acid component that may be used include maleic acid, maleic anhydride, fumaric acid, phthalic acid, terephthalic acid, isophthalic acid, malonic acid, succinic acid, glutaric acid, dodecenyl succinic acid, n-octylsuccinic acid, n-dodecenylsuccinic acid, 1,2,4-benzenetricarboxylic acid, 1,2,4-cyclohexanetricarbocylic acid, 1,2,4-naphthalenetricarbocylic acid, 1,2,5-hexanetricarboxylic acid, 1,3-dicarboxyl-2-methyl-2-methylenecarboxylpropane, tetra(methylenecarboxyl) methane, 1,2,7,8-octanetetracarboxylic acid, trimellitic acid, pyromellitic acid, and lower alkyl esters thereof.

The polyester resin is synthesized by using one or more components of the above polyalcohol components and one or more components of the above polycarboxylic acid components. Also, in the case of the color toner, the toner mainly contains a polyester resin; in the case of the monochrome toner, the toner mainly contains the styrene-acrylic resin. Thus, the resin composition highly compatible with the toner is preferably selected. Accordingly, one or two or more resins are selected from the polyester resins, the styrene-acrylate resins, the styrene-methacrylate resins, and the like according to the application, and are mixed in use.

Further, the image receiving layer 18*a* can contain a pigment, a releasing agent, a conductive agent, or the like within such a range as not to impair the properties. In this case, the content of the resin as the main component based on the total amount of resin should be 80 wt % or higher. Further, the image receiving layer 18*a* is preferably adjusted to have the surface electric resistance of $8.0\times10^{8}\Omega$ or higher at a temperature of 20° C. and a relative humidity of 85%. Note that, the above releasing agent is added into the image receiving layer 18*a* as needed with a content of 0.5 wt % to 10 wt %.

As the base material 18*b* serving as the support member, general woodfree paper is used. The front and rear sides of the base material 18*b* are both coated with the coating layers 18*c* made of polyethylene, polypropylene, polyethylene terephthalate, polystyrene, etc. with a thickness of 10 to 30 μm. The coating layer 18*c* covers the front and rear sides of the support member, and then undergoes a smoothing process including general curing step and surface treatment step. Note that, the surface to be coated with the coating layer 18*c* is adjusted, at the time of undergoing the smoothing process, such that a maximum roughness Rmax based on JIS K 0601 is set to 20 μm or smaller.

As a back layer 18*d*, a layer is used, in which adhesives such as the polyester resin are added to the inorganic pigment etc. and the resultant is lightly applied with a predetermined thickness. Examples of the pigment used in the back layer 44 include mineral pigments such as heavy calcium carbonate, precipitated calcium carbonate, kaolin, calcined kaolin, constitutive property kaolin, delaminated kaolin, talc, calcium sulfate, barium sulfate, titanium dioxide, zinc oxide, alumina, magnesium carbonate, magnesium oxide, silica, magnesium aminosilicate, particulated calcium silicate, particulated magnesium carbonate, particulated precipitated calcium carbonate, white carbon, bentonite, zeolite, sericite, and smectite, organic pigments such as polystyrene resins, styrene-acrylic copolymer resins, urea resins, melamine resins, acrylic resins, polyvinylidene chloride resins, benzoguanamine resins, microparticles thereof, and through-hole type organic pigments. These may be used singly or in combination of two or more.

The adhesive used in the back layer 18*d* is selected while considering the adhesive property of the base material 18*b* of photographic paper to the coating layer 18*c* and the like. Examples thereof include synthetic polymer compounds such as a polyester resin, a polyurethane resin, a polyolefin resin, an olefin-maleic anhydride resin, and a melamine resin. Of those, the polyester resin is preferred.

A blending amount of the adhesive used in the back layer 18*d* is 100 to 400 wt % with respect to 20 wt % of pigment.

Also, in the back layer 18*d*, 0.5 to 5 parts by weight of releasing agent or lubricant is preferably blended with respect to 100 parts by weight of inorganic pigment. If the blending amount of the releasing agent or lubricant is less than 0.5 part by weight, the image receiving layer 18*a* and the back layer 18*d* exhibit the excessive adhesion to each other, so that a coefficient of friction between the sheets increases and a running stability deteriorates. On the other hand, if the amount exceeds 5 parts by weight, a problem arises in that a paper powder is generated due to the reduced strength of the back layer 18*d*.

Examples of the releasing agent or lubricant of this embodiment include: higher fatty acids such as stearic acid; higher fatty acid metal salts such as zinc stearate; higher fatty acid amides such as stearic acid amides and a methylolated product thereof; and hydrocarbons such as polyethylene wax.

A coating liquid of the back layer 18*d* contains, in addition to the above, various assistants. For example, there may be appropriately used surfactants, ph adjusting agents, viscosity adjusting agents, softeners, gloss imparting agents, waxes, dispersants, flow stabilizers, conduction preventing agents, stabilizers, antistatic agents, cross-linking agents, sizing agents, fluorescent whiteners, colorants, UV absorbents, defoaming agents, waterproofing agents, plasticizers, lubricants, antiseptic agents, and perfumery, as needed.

The coating amount of the back layer 18*d* is set according to the application of the transfer sheet of the present invention while considering a curl balance or the like; however, in general, the amount needs to be large enough to completely cover the unevennesses on the surface of the support member having both sides coated with the coating layers 18*c*. The amount is preferably 8 to 40 g/m$^2$ in terms of dry weight. In general, the coating method used for forming the back layer 18*d* may adopt any known coater as appropriate, for example, a blade coater, an air-knife coater, a roll coater, a reverse roll coater, a bar coater, a curtain coater, a die slot coater, a gravure coater, a champlex coater, a brush coater, a two-roll coater, a metering blade type size press coater, a bill blade coater, a short dwell coater, and a gate roll coater.

At the time of smoothing the back layer 18*d*, general smoothing apparatuses such as a super calender, a gloss calender, and a soft calender are used without using any special apparatus. Also, the apparatus is appropriately used on-machine or off-machine. The form of the pressure device, the number of pressure nips, and the heating conditions are appropriately adjusted on the basis of the general smoothing apparatus.

As the support member used as the base material 18*b* of the present invention is not particularly limited, but may be a paper base material such as acid paper made at pH of around 4.5 or acid-free paper made at pH of about 6 (weakly acidic condition) to about 9 (weakly alkaline condition) mainly containing an alkaline filler such as calcium carbonate. In a paper making method, general paper making machines may be appropriately used, such as fourdrinier multi-tube type, a cylinder single-tube type, and a Yankee type. Also, synthetic paper, nonwoven cloth, and a synthetic resin film can be used according to its application.

In coating the base material 18*b* with the image receiving layer 18*a*, generally known coaters such as reverse roll coaters, bar coaters, curtain coaters, die slot coaters, and gravure coaters can be appropriately used.

Further, the recording sheet 18 coated with the image receiving layer 18*a* can undergo the smoothing process as needed with the general smoothing apparatuses such as super calenders, gloss calenders, and soft calenders. Also, the form of the pressure device, the number of pressure nips, the heating condition, etc. are adjusted as appropriate on the basis of the general smoothing apparatus. Note that VST (Vicat softening temperature) of the thermoplastic resin is measured by an experimental method based on JIS K 7206.

[Raw Material for Color Toner]

On the other hand, the toner of the color toner to be transferred and fixed onto the recoding sheet 18 is toner for electrostatic latent image development, which is obtained by solving and dispersing, for example, a binder resin, a colorant, and a releasing agent into an organic solvent to prepare an oil component and dispersing the oil component into an aqueous medium, followed by granulation. The toner contains inorganic fine particles as needed.

Examples of the inorganic fine particles dispersed into the toner include: metal salts such as calcium carbonate, calcium phosphate, and barium sulfate; metal oxides such as silicone oxide, titanium oxide, aluminum oxide, barium titanate, strontium titanate, calcium titanate, cerium oxide, zirconium oxide, and magnesium oxide; ceramics; and carbon black. Each of them can be used singly or two or more elements thereof can be used in combination. Of those, the inorganic fine particle having a small difference in refractive index with the binder resin, such as the silicon oxide is particularly preferred because satisfactory color development and OHP permeability are achieved.

Also, a particle size of the inorganic fine particle is preferably 4 nm or more and 500 nm or less, more preferably 6 nm or more and 50 nm or less. If the particle size exceeds 500 nm, effects are insufficient. Moreover, the addition amount of the inorganic fine particle into the toner is preferably 1 part by weight or more and 20 parts by weight or less with respect to 100 parts by weight of toner, more preferably 2 parts by weight or more and 10 parts by weight or less. If the addition amount is less than 1 part by weight or above 20 parts by weight, a fixability is poor.

Those inorganic fine particles are preferably subjected to surface treatment that imparts a hydrophobic property, with a coupling agent etc. so as not to separate from the toner in the production process. Specific examples of the coupling agent include, silane coupling agents such as methyltrichlorosilane, methyldichlorosilane, dimethyldichlorosilane, trimethylchlorosilane, phenyltrichlorosilane, diphenyldichlorosilane, tetramethoxysilane, methyltrimethoxysilane, dimethyldimethoxysilane, phenyltrimethoxysilane, diphenyldimethoxysilane, tetraethoxysilane, methyltriethoxysilane, dimethyldiethoxysilane, phenyltriethoxysilane, diphenyldiethoxysilane, isobutyltrimethoxysilane, decyltrimethoxysilane, hexamethylsilazane, N,N-(bistrimethylsilyl)acetamide, N,N-bis(trimethylsilyl)urea, tert-butyldimethylchlorosilane, vinyltrichlorosilane, vinyltrimethoxysilane, vinyltriethoxysilane, γ-methacryloxypropyltrimethoxysilane, β-(3,4-epoxycyclohexyl)ethyltrimethoxysilane, γ-glycidoxypropyltrimethoxysilane, γ-glycidoxypropylmethyldiethoxysilane, γ-mercaptopropyltrimethoxysilane, and γ-chloropropyl trimethoxysilane, and titanium coupling agents. The coupling agent, is used for the reason that a rate at which the inorganic fine particles are taken into the toner drops when lipophilicity is low.

Well-known resins for the fixing process may be used as the binder resins, and specific examples thereof include polyesters obtained through condensation polymerization of an alcohol component and a carboxylic acid component. Examples of the alcohol component include alcohols that are dihydric or higher such as ethylene glycol, diethylene glycol, triethylene glycol, polyethylene glycol, propylene glycol, butanediol, pentanediol, hexanediol, cyclohexanedimethanol, xylylene glycol, dipropylene glycol, polypropylene glycol, bisphenol A, hydrogenated bisphenol A, bisphenol A ethylene oxide, bisphenol A propylene oxide, sorbitol, and glycerine, and derivatives thereof. Examples of the carboxylic acid component include carboxylic acids that are divalent or more such as maleic acid, fumaric acid, phthalic acid, isophthalic acid, terephthalic acid, succinic acid, adipic acid, trimellitic acid, pyromellitic acid, cyclopentanedicarboxylic acid, succinic anhydride, trimellitic anhydride, maleic anhydride, and dodecenyl succinic anhydride, and derivatives and anhydrides thereof. Note that the alcohol component and the carboxylic acid component may be used in combination of two or more.

Further, acrylate polymers such as methyl polyacrylate, ethyl polyacrylate, butyl polyacrylate, 2-ethylhexyl polyacrylate, and lauryl polyacrylate; methacrylate polymers such as methyl polymethacrylate, butyl polymethacrylate, hexyl polymethacrylate, 2-ethylhexyl polymethacrylate, and lauryl polymethacrylate; copolymer of acrylate or methacrylate; copolymer of a styrene monomer and acrylate or methacrylate; ethylene polymers such as polyvinyl acetate, polyvinyl propionate, polyvinyl butyrate, polyethylene, and polypropylene, and copolymers thereof; styrene copolymers such as styrene-butadiene copolymer, styrene-isoprene copolymer, and styrene-maleic acid copolymer; polyvinyl ether; polyvinyl ketone; polyester; polyamide; polyurethane resin; and phenol resin may be used singly or as a mixture thereof.

Specific examples of the waxes used as the releasing agent in this embodiment include: petroleum waxes such as paraffin waxes, paraffin oxide wax, and microcrystalline wax; mineral waxes such as montan wax; vegetable and animal waxes such as bees wax and carnauba wax; and synthetic waxes such as polyolefin wax, polyolefin oxide wax, and Fischer-Tropsch wax. They each can be used singly or used in combination. A melting point of the wax is preferably 40° C. to 150° C., more preferably 50° C. to 100° C.

It is desirable to more finely disperse the waxes in advance to have an average particle size of 1 μm or smaller. Given as a wax dispersing method, with which the wax particle size can be reduced are a method of subjecting the waxes to wet pulverization in an organic solvent with a media mill, a method of solving the waxes in the organic solvent, and then cooling the mixture to precipitate, and finely dispersing the resultant, and a method of evaporating the waxes in a vapor phase to obtain fine particles.

It is not always necessary that the organic solvent used is the same as the solvent used in solving the binder resin. The content of the solvent is preferably 0.1 to 20 parts by weight with respect to 1 part by weight of wax.

The waxes may be solved by applying the heat and the pressure thereto. In the method of evaporating the waxes in the vapor phase to obtain the fine particle, inert gases such as helium, argon, and nitrogen are used for the vapor phase and the waxes are heated at 100° C. to 400° C. to be evaporated under the depressurized condition of 0.01 to 10 torr. The evaporated wax fine particles adhere to the cooled base material, followed by scraping off the particles or dispersing the particles into the solvent to thereby obtain the fine particles. Upon the toner granulation, the powder of the wax fine particle may be either added as is or dispersed into the solvent. In this method, by adjusting the temperature and the depressurization degree, the fraction exhibiting the narrow molecular weight distribution can be separated as well.

As the pigments used in this embodiment, any known organic or inorganic pigment can be used. Examples thereof include: carbon black such as furnace black, channel black, acetylene black, or thermal black; inorganic pigments such as red iron oxide, iron blue, and titanium oxide; azo pigments such as fast yellow, disazo yellow, pyrazolone red, chelate red, brilliant carmine, para brown, and benzimidazolone; phthalocyanine pigments such as copper phthalocyanine and non-metal phthalocyanine; condensed polycyclic pigments such as flavanthrone yellow, dibromoanthrone orange, perylene red, quinacridone red, and dioxazine violet; and carmine lake pigments.

Note that in this embodiment, as magnetic one-component toner, all or part of the black colorant can be replaced by magnetic powder. Examples of the magnetic power include magnetite, ferrite, or a metal element such as cobalt, iron, or nickel, or an alloy thereof. The above colorant is added with a content of about 1 to 50 parts by weight, preferably 2 to 20 parts by weight with respect to 100 parts by weight of resin.

As the pigment dispersing method of this embodiment, the pigment can be dispersed with a media disperser such as a sand mill, a ball mill, an atrritor, or a coball mill, a roll mill such as a triple roll mill, a cavitation mill such as a nanomizer, and a colloid mill. For applying an appropriate shearing force upon dispersing the pigments, a part of binder resin may be added to adjust the viscosity.

The pigment dispersing agent is preferably added for keeping the dispersed conditions of the pigment in a stable manner. Specific examples of the pigment dispersing agent include: EFKA 47, EFKA 4009, and EFKA 4010 (modified polyurethane: produced by EFKA CHEMICALS Co., Ltd.); Ajisper PB711, Ajisper PB411, and Ajisper PA111 (produced by AJINOMOTO PHARMA Co., Ltd.); and Disparon DA-703-50, Disparon DA-705, Disparon DA-725, and Disparon DA-400N (polyester: produced by Kusumoto Kasei K. K.).

Also, to disperse the pigments in a more stabilized manner by more firmly bonding the pigment and the pigment dispersing agent, it is preferable to add the pigment derivatives etc. or to disperse the surface-treated pigments. Specific examples of the pigment derivatives include: sulfonic acid derivatives of dimethylaminoethyl quinacridone, dihydroquinacridone, and anthraquinone; carboxylic acid derivatives of anthraquinone; Solsperse 5000, Solsperse 12000, and Solsperse 22000 (produced by Zeneca Co., Ltd.); and EFKA-745 and LP 6750 (EFKA CHEMICALS Co., Ltd.). Also, examples of the surface treating agent for the pigment include: natural rosins such as gum rosin, wood rosin, and tall rosin; abietic acid derivatives of abietic acid, levopimaric acid, dextropimaric acid, etc., and metal salts thereof such as calcium salts, sodium salts, potassium salts, and magnesium salts; a rosin-maleic acid resin; and a rosin-phenolic acid resin. The contents of the pigment derivatives and the surface treating agent for the pigment are preferably 0.1 to 100 wt %, more preferably 0.1 to 10 wt % with respect to the pigment.

In this embodiment, the charge control agent may be used. The conventional one used in the developer may be used. Preferred are a compound used in a toner powder for xerography and selected from the group consisting of a benzoic acid metal salt, a salicylic acid metal salt, an alkylsalicylic acid metal salt, a cathecol metal salt, a metal-containing bisazo dye, tetraphenyl borate derivatives, a quaternary ammonium salt, and an alkyl pyridinium salt, a polar-group containing resin-type charge control agent, and an appropriate combination thereof. The addition amount of the charge control agent to the toner solid content is generally 10 wt % or smaller.

As other additives, the fine particles are preferably added to the toner surface for imparting the flowability etc. Specific examples of the fine particles include: metal salts; resins; metal oxides such as silicon oxides, titanium oxides, aluminum oxides, barium titanates, strontium titanates, calcium titanates, cerium oxides, zirconium oxides, and magnesium oxides; ceramics; and carbon black.

Those inorganic fine particles are preferably subjected to the surface treatment with the coupling agent etc. for controlling the conductivity and the charging property. Specific examples of the coupling agent include silane coupling agents such as methyltrichlorosilane, methyldichlorosilane, dimethyldichlorosilane, trimethylchlorosilane, phenyltrichlorosilane, diphenyldichlorosilane, tetramethoxysilane, methyltrimethoxysilane, dimethyldimethoxysilane, phenyltrimethoxysilane, diphenyldimethoxysilane, tetraethoxysilane, methyltriethoxysilane, dimethyldiethoxysilane, phenyltriethoxysilane, diphenyldiethoxysilane, isobutyltrimethoxysilane, decyltrimethoxysilane, hexamethylsilazane, N,N-(bistrimethylsilyl)acetamide, N,N-bis(trimethylsilyl)urea, tert-butyldimethylchlorosilane, vinyltrichlorosilane, vinyltrimethoxysilane, vinyltriethoxysilane, γ-methacryloxypropyltrimethoxysilane, β-(3,4-epoxycyclohexyl)ethyltrimethoxysilane, γ-glycidoxypropyltrimethoxysilane, γ-glycidoxypropylmethyldiethoxysilane, γ-mercaptopropyltrimethoxysilane, and γ-chloropropyltrimethoxysilane, and titanium coupling agent.

Note that as the method of adding the fine particles, after the toner is dried, the fine particles may be adhered onto the toner surface in a wet manner by using a mixer such as a V blender or a Henschel mixer. Alternatively, after the fine particles are dispersed into the water or a water-based liquid like water/alcohol, the resultant may be added to the toner in a slurry form and dried to adhere the external additives to the toner surface. Also, the slurry may be sprayed onto the dry powder with drying.

Specific examples of the method of forming the toner particles of this embodiment include: a method of solving and dispersing the binder resin, the colorant, the wax (releasing agent), the inorganic fine particles, and other materials into the solvent to obtain the oil component and suspending and dispersing the obtained oil component in the aqueous solvent, followed by removing the solvent; and a method of adding a poor solvent to the solution to precipitate the particles.

As the aqueous medium (solvent), the water is mainly used but the water-soluble solvent may be mixed there with. For dispersing the oil component in the aqueous solvent in a stable manner, it is preferable to add the inorganic fine particles and/or a water-soluble polymer. Examples of the inorganic fine particles added include: calcium phosphate; hydroxyapatite; calcium carbonate; titanium oxide; aluminum hydroxide; magnesium hydroxide; barium phosphate; and silicon oxide. The content of the inorganic dispersing agent is preferably 1 to 30 parts by weight with respect to 100 parts by weight of aqueous solvent. The average particle size of the inorganic dispersing agent is preferably 1 μm or smaller. The water-soluble polymer is specifically exemplified by cellulose, hydroxypropyl methylcellulose, methylcellulose, carboxymethylcellulose, starch, polyvinyl alcohol, polyacrylic acid, and the like.

The general organic solvent is used as the solvent. Examples thereof include: hydrocarbon such as toluene or xylene; halogenated hydrocarbon such as methylene chloride, chloroform, or dichloloethane; ethers such as tetrahydrofuran; esters such as methyl acetate, ethyl acetate, and butyl acetate; and ketones such as methylethyl ketone and cyclohexanone. They can be each used singly or used in combination.

The agitating method used for forming the particle adopts: a rotor stator type agitator such as a homogenizer or a colloid mill; an impeller type agitator such as a dissolver; an ultrasonic agitator; and the like. The toner of this embodiment has the average particle size of 3 μm or more and 10 μm or less. Also, there are known devices that dry the toner, such as an air dryer; a spray dryer; a rotation drying device; an airborne dryer; a fluidized-bed dryer; a heat-transfer type dryer; and a freeze-drying device. Any of those devices can be used.

As described above, according to the present invention, both the elimination of the step-like appearance of the toner image on the recording sheet and the prevention of the blister in the resin layer of the recording sheet are realized, whereby the fixing device capable of achieving the photographic image quality and photographic quality and the image forming apparatus using the same can be provided.

What is claimed is:

1. A relief smoothing apparatus that smoothes an image on a recording sheet which is obtained by forming a polyolefin resin coating layer on at least one side of a base sheet and forming a receiving layer, in which a toner image is infiltrated, on at least one side of the base sheet, comprising:

plural tension rolls including a first roll;

an endless belt stretched over the plural tension rolls in a rotatable manner;

a second roll that comes into press contact with the first roll through the endless belt to form a nip portion; and a heating source that heats at least one of the first roll and the second roll, the recording sheet having the receiving layer side which is brought into close contact with the endless belt at the nip portion and is peeled off from the endless belt after being transported and cooled together with the endless belt, wherein provided that a surface temperature of the first roll is represented by Tn [° C.], a Vicat softening temperature of the polyolefin resin is represented by Tv [° C.], and a time required for the recording sheet to pass through the nip portion is represented by t [sec], the following relationship is established:

$$(Tv+55)\times(1+1/100t)\geqq Tn\geqq(Tv+20)/(1+1/100t)[^\circ\text{ C.}].$$

2. A relief smoothing apparatus that smoothes an image on a recording sheet which is obtained by forming a polyolefin resin coating layer on at least one side of a base sheet and forming a receiving layer, in which a toner image is infiltrated, on at least one side of the base sheet, comprising:

plural tension rolls including a first roll;

an endless belt stretched over the plural tension rolls in a rotatable manner;

a second roll that comes into press contact with a heating roll through the endless belt to form a nip portion; and a heating source that heats at least one of the first roll and the second roll, the recording sheet having the receiving layer side which is brought into close contact with the endless belt at the nip portion and is peeled off from the endless belt after being transported and cooled together with the endless belt, wherein provided that a pressure of the nip portion is represented by P [MPa] and a time required for the recording sheet to pass through the nip portion is represented by t [sec], the following relationships are established:

$$0.50 \geqq P \cdot t[\text{MPa·s}],\ P \geqq 1.0[\text{MPa}],\ \text{and}\ t \geqq 0.1[\text{sec}].$$

3. A relief smoothing apparatus that smoothes an image on a recording sheet which is obtained by forming a polyolefin resin coating layer on at least one side of a base sheet and forming a receiving layer, in which a toner image is infiltrated, on at least one side of the base sheet, comprising:

plural tension rolls including a first roll;

an endless belt stretched over the plural tension rolls in a rotatable manner;

a second roll that comes into press contact with a heating roll through the endless belt to form a nip portion; and a heating source that heats at least one of the first roll and the second roll, the recording sheet having the receiving layer side which is brought into close contact with the endless belt at the nip portion and is peeled off from the endless belt after being transported and cooled together with the endless belt, wherein provided that a surface temperature of the first roll is represented by Tn [° C.], a Vicat softening temperature of the polyolefin resin is represented by Tv [° C.], a pressure of the nip portion is represented by P [MPa], and a time required for the recording sheet to pass through the nip portion is represented by t [sec], the following relationships are established:

$$(Tv+55)\times(1+1/100t) \geqq Tn \geqq (Tv+20)/(1+1/100t)[^\circ\ \text{C.}],$$

and $$0.50 \geqq P \cdot t[\text{MPa·s}],\ P \geqq 1.0[\text{MPa}],\ \text{and}\ t \geqq 0.1[\text{sec}].$$

4. A relief smoothing apparatus according to claim 1, wherein when the polyolefin resin coating layers formed on both sides of the base sheet are different from each other, a lower Vicat softening temperature is adopted as the Vicat softening temperature Tv of the polyolefin resin.

5. A relief smoothing apparatus according to claim 3, wherein when the polyolefin resin coating layers formed on both sides of the base sheet are different from each other, a lower Vicat softening temperature is adopted as the Vicat softening temperature Tv of the polyolefin resin.

6. A relief smoothing apparatus according to claim 1, further comprising a cooling member that cools a region on a downstream side of the nip portion from inside the endless belt.

7. A relief smoothing apparatus according to claim 2, further comprising a cooling member that cools a region on a downstream side of the nip portion from inside the endless belt.

8. A relief smoothing apparatus according to claim 3, further comprising a cooling member that cools a region on a downstream side of the nip portion from inside the endless belt.

9. A fixing device comprising the relief smoothing apparatus according to claim 1, wherein the endless belt is used as a fixing belt and a toner image held on an image receiving layer side of a recording sheet is fixed.

10. A fixing device comprising the relief smoothing apparatus according to claim 2, wherein the endless belt is used as a fixing belt and a toner image held on an image receiving layer side of a recording sheet is fixed.

11. A fixing device comprising the relief smoothing apparatus according to claim 3, wherein the endless belt is used as a fixing belt and a toner image held on an image receiving layer side of a recording sheet is fixed.

12. An image forming apparatus comprising the fixing device according to claim 9.

13. An image forming apparatus comprising the fixing device according to claim 10.

14. An image forming apparatus comprising the fixing device according to claim 11.

15. An image forming apparatus comprising:

a first fixing device; and a second fixing device provided on a downstream side in a transport direction of the first fixing device, the second fixing device comprising the fixing device according to claim 9, with a first mode in which only the first fixing device performs a fixing process on a recording sheet and a second mode in which the first fixing device and the second fixing device perform the fixing process on the recording sheet.

16. An image forming apparatus comprising:

a first fixing device; and a second fixing device provided on a downstream side in a transport direction of the first fixing device, the second fixing device comprising the fixing device according to claim 10, with a first mode in which only the first fixing device performs a fixing process on a recording sheet and a second mode in which the first fixing device and the second fixing device perform the fixing process on the recording sheet.

17. An image forming apparatus comprising:

a first fixing device; and a second fixing device provided on a downstream side in a transport direction of the first fixing device, the second fixing device comprising the fixing device according to claim 11, with a first mode in which only the first fixing device performs a fixing process on a recording sheet and a second mode in which the first fixing device and the second fixing device perform the fixing process on the recording sheet.

18. An image forming apparatus comprising the relief smoothing apparatus according to claim 1, wherein the endless belt is used as an intermediate transfer belt and a toner image held on the intermediate transfer belt is transferred and fixed onto an image receiving layer side of a recording sheet.

19. An image forming apparatus comprising the relief smoothing apparatus according to claim 2, wherein the endless belt is used as an intermediate transfer belt and a toner image held on the intermediate transfer belt is transferred and fixed onto an image receiving layer side of a recording sheet.

20. An image forming apparatus comprising the relief smoothing apparatus according to claim 3, wherein the endless belt is used as an intermediate transfer belt and a toner image held on the intermediate transfer belt is transferred and fixed onto an image receiving layer side of a recording sheet.

* * * * *